US011906228B2

(12) United States Patent
Zhou et al.

(10) Patent No.: US 11,906,228 B2
(45) Date of Patent: Feb. 20, 2024

(54) COLD STORAGE MATERIAL AND COLD STORAGE TYPE CRYOGENIC REFRIGERATOR USING SAME

(71) Applicant: CSIC PRIDE (NANJING) CRYOGENIC TECHNOLOGY CO., LTD., Jiangsu (CN)

(72) Inventors: Zhipo Zhou, Jiangsu (CN); Ao Li, Jiangsu (CN); Weiwei Zeng, Jiangsu (CN); Yuan Tao, Jiangsu (CN)

(73) Assignee: CSIC PRIDE (NANJING) CRYOGENIC TECHNOLOGY CO., LTD., Jiangsu (CN)

( * ) Notice: Subject to any disclaimer, the term of this patent is extended or adjusted under 35 U.S.C. 154(b) by 475 days.

(21) Appl. No.: 15/734,950

(22) PCT Filed: Aug. 8, 2018

(86) PCT No.: PCT/CN2018/099437
§ 371 (c)(1),
(2) Date: Dec. 3, 2020

(87) PCT Pub. No.: WO2019/232919
PCT Pub. Date: Dec. 12, 2019

(65) Prior Publication Data

US 2021/0231349 A1 Jul. 29, 2021

(30) Foreign Application Priority Data

Jun. 4, 2018 (CN) ..... 201810565104

(51) Int. Cl.
*F25B 9/14* (2006.01)
*C22C 13/02* (2006.01)
(Continued)

(52) U.S. Cl.
CPC ..... *F25B 9/14* (2013.01); *B22F 1/00* (2013.01); *B22F 1/05* (2022.01); *B22F 1/065* (2022.01);
(Continued)

(58) Field of Classification Search
CPC .... B22F 2304/15; B22F 2301/30; B22F 1/05; F25B 9/14
See application file for complete search history.

(56) References Cited

FOREIGN PATENT DOCUMENTS

CN 1212722 A 3/1999
CN 101124289 A 2/2008
(Continued)

OTHER PUBLICATIONS

Lei, Regenerator material and regenerative refrigerator, 2014, Full Document (Year: 2014).*
(Continued)

*Primary Examiner* — Nael N Babaa
(74) *Attorney, Agent, or Firm* — Gary J. Gershik

(57) ABSTRACT

Disclosed are a cold storage material and a cold storage type cryogenic refrigerator using same. The cold storage material is tin alloy particles, the content of tin in the tin alloy particle is not less than 40% and not more than 99%, and the cold storage material at least includes one component of bismuth, antimony, silver and gold. The cold storage type cryogenic refrigerator includes a cold storage device, and the cold storage material filled in the cold storage device is tin alloy particles, is lead-free, lowly toxic, easy in spherization and extremely accessible and has a relatively good thermal performance, has properties comparable to those of lead, and has a relatively good heat exchange performance when being used in a cold storage type refrigerator.

4 Claims, 6 Drawing Sheets

(51) Int. Cl.
*B22F 1/05* (2022.01)
*B22F 1/065* (2022.01)
*B22F 1/00* (2022.01)

(52) U.S. Cl.
CPC ..... *C22C 13/02* (2013.01); *B22F 2301/30* (2013.01); *B22F 2304/15* (2013.01); *F25B 2309/023* (2013.01)

(56) References Cited

FOREIGN PATENT DOCUMENTS

| | | | | | |
|---|---|---|---|---|---|
| CN | 103344147 | A | | 10/2013 | |
| CN | 104232026 | A | * | 12/2014 | ..... C22C 12/00 |
| CN | 104232026 | A | | 12/2014 | |
| JP | 4237791 | B2 | | 3/2009 | |
| TW | I539125 | B | * | 11/2014 | |
| WO | WO 2019/232919 | A1 | | 12/2019 | |

OTHER PUBLICATIONS

Hsiang, Stirling heating and cooling apparatus, 2014, Full Document (Year: 2014).*
International Search Report dated Mar. 7, 2019 in connection with PCT International Application No. PCT/CN2018/099437.
Written Opinion (form PCT/ISA/237) dated Mar. 7, 2019 in connection with PCT International Application No. PCT/CN2018/099437.

* cited by examiner

COLD STORAGE MATERIAL AND COLD STORAGE TYPE CRYOGENIC REFRIGERATOR USING SAME

CROSS-REFERENCE TO RELATED APPLICATIONS

This application is a § 371 national stage of PCT International Application No. PCT/CN2018/099437, filed Aug. 8, 2018, claiming priority of Chinese Patent Application No. 201810565104.5, filed Jun. 4, 2018, the contents of each of which are hereby incorporated by reference herein.

BACKGROUND

Technical Field

The present invention relates to the technical field of cryogenic refrigerators, in particular, to a cold storage material used by a cryogenic refrigerator, and specifically, to a cold storage material that is lead-free, lowly toxic, easy in spherization and extremely accessible and has a relatively good thermal performance and a cold storage type cryogenic refrigerator using same.

Related Art

A cold storage type refrigerator is a joint name of refrigerators having a cold storage device, for example, a GM refrigerator, a Stirling refrigerator, a pulse tube refrigerator and a Solvag refrigerator. A heat exchange material filled in the cold storage device is referred to as a cold storage material. The material, as the cold storage material, needs to have a relatively large specific heat capacity in a corresponding temperature zone. If a cryogenic refrigerator needs to implement a refrigeration effect in a temperature zone from a room temperature to 4K, it is required that a specific heat of the cold storage material selected in a corresponding temperature zone range should be as large as possible. Volumes and specific heats of a same type of material in different temperature zones and different materials in a same type of temperature zone are all different. As a result, no material can be applied to all temperature zones, and different material combination manners need to be adopted according to distribution of the temperature zones. In a temperature zone from the room temperature to 40K, a stainless steel or a phosphor bronze wire mesh is used, as shown in FIG. 1: spherical lead (Pb) is used from 40K to 10K, and spherical holmium-cuprum ($HoCu_2$) is used below 10K. Lead has a larger specific heat in a temperature zone from 40K to 10K than those of other materials, and is cheap and accessible, and therefore is an optimal cold storage material in the temperature zone. However, in terms of environmental protection, lead is a type of heavy metal harmful to humans, and has a toxic effect on nerves. Different levels of toxic effects appear in all animals and plants after absorbing lead. It is proposed in some literatures and patents that lead is replaced with a metal, bismuth. Although bismuth has properties approximately comparable to those of lead, the academia has not reached an authoritative conclusion on toxicity of bismuth by now. It is not necessarily appropriate to use a large amount of bismuth in the cold storage material.

SUMMARY

An objective of the present invention is aiming at problems existing in the prior art, to provide a cold storage material that is lead-free, lowly toxic, easy in spherization and extremely accessible and has a relatively good thermal performance and a cold storage type cryogenic refrigerator using same.

The objective of the present invention is achieved by the following technical solution.

A cold storage material is provided, where the cold storage material is tin alloy particles, and the content of tin in the tin alloy particle is not less than 40% and not more than 99%.

Apart from a main component, tin, the cold storage material at least includes one component of bismuth, antimony, silver and gold, that is, the cold storage material is a binary alloy or a multi-component alloy of tin.

Granules with a diameter between 0.15 mm and 1 mm of the tin alloy particles in the cold storage material account for not less than 65% of a weight of the entire tin alloy particles.

Granules of which a ratio of a short diameter of the granule to a long diameter is greater than 0.7 of the tin alloy particles in the cold storage material account for not less than 65% of the entire tin alloy particles.

The cold storage material is manufactured into the tin alloy particles through melted metal quenching, or plasma or gas atomization.

A cold storage type cryogenic refrigerator is provided, including a cold storage device, where a cold storage material filled in the cold storage device is tin alloy particles.

The cold storage device includes a first-stage pushing piston and/or a second-stage pushing piston, and a first-stage cold storage material filled in the first-stage pushing piston and/or a second-stage cold storage material filled in the second-stage pushing piston uses tin alloy particles.

When the first-stage cold storage material uses tin alloy particles, the tin alloy particles serve as the first-stage cold storage material of a cold end of the first-stage pushing piston.

The second-stage cold storage material includes a second-stage hot end cold storage material and a second-stage cold end cold storage material, the tin alloy particles serve as the second-stage hot end cold storage material of a hot end of the second-stage pushing piston and the second-stage cold end cold storage material of a cold end of the second-stage pushing piston uses GOS or $HoCu_2$.

When the second-stage hot end cold storage material uses the tin alloy particles and the second-stage cold end cold storage material uses GOS or $HoCu_2$, the cold storage type cryogenic refrigerator is a 4-K cryogenic refrigerator for nuclear magnetic resonance and is applied to a superconductive system.

The refrigerator includes a Gifford-McMahon (GM) refrigerator, a Stirling refrigerator, a Solvag refrigerator or a pulse tube refrigerator, but is not limited to the foregoing cryogenic refrigerators, and any cryogenic refrigerator having a cold storage device is applicable.

Compared with the prior art, the present invention has the following advantages:

The cold storage material provided by the present invention is lead-free, lowly toxic, easy in spherization and extremely accessible and has a relatively good thermal performance, and the cold storage material has properties comparable to those of lead; and the cold storage material has a relatively good heat exchange performance, when being used in a cold storage type refrigerator.

1: compressor; 2: cover assembly; 3: gas pipeline; 7: sealing ring: 8: hot cavity; 9: first-stage expansion chamber; 10: second-stage expansion chamber; 11: first-stage pushing piston; 11*a*: first-stage piston front hole; 11*b*: first-stage piston rear hole; 11*c*: first-stage cold storage material; 12: second-stage pushing piston; 12*a*: second-stage piston front hole; 12*b*: exhaust port; 12*c*: second-stage cold storage material; 12*c*1: second-stage hot end cold storage material; 12*c*2: second-stage cold end cold storage material; 12*d*: second-stage piston cylinder; 13: air cylinder; 13*b*: second-stage heat exchanger; 30: partition member; GOS: $Gd_2O_2S$ (gadolinium oxysulfide); $HoCu_2$: holmium-cuprum; Pb: lead; Bi bismuth; Sn: tin.

DETAILED DESCRIPTION

The present invention is further described below with reference to the accompanying drawings and embodiments.

A cold storage material is provided, where the cold storage material is tin alloy particles, and the content of tin in the tin alloy particle is not less than 40% and not more than 99%; and apart from a main component, tin, the cold storage material at least includes one component of bismuth, antimony, silver and gold, that is, the cold storage material is a binary alloy or a multi-component alloy of tin. In addition, granules with a diameter between 0.15 mm and 1 mm of the tin alloy particles in the cold storage material account for not less than 65% of a weight of the entire tin alloy particles; and granules of which a ratio of a short diameter of the granule to a long diameter is greater than 0.7 of the tin alloy particles in the cold storage material account for not less than 65% of the entire tin alloy particles. The foregoing cold storage material is manufactured into the tin alloy particles through melted metal quenching, or plasma or gas atomization.

Figure 1:
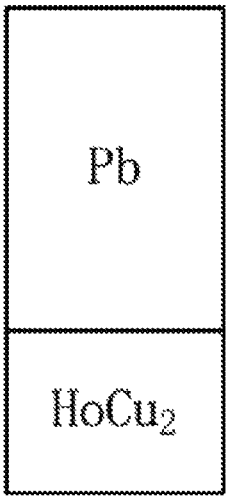
FIG. 1 is a schematic distribution diagram of a cold storage material filled in a lead cold storage device in the prior art.
Figure 2:
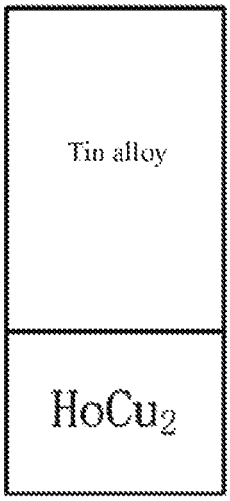
FIG. 2 is a schematic distribution diagram of a cold storage material filled in a tin alloy cold storage device of the present invention.
Figure 3:
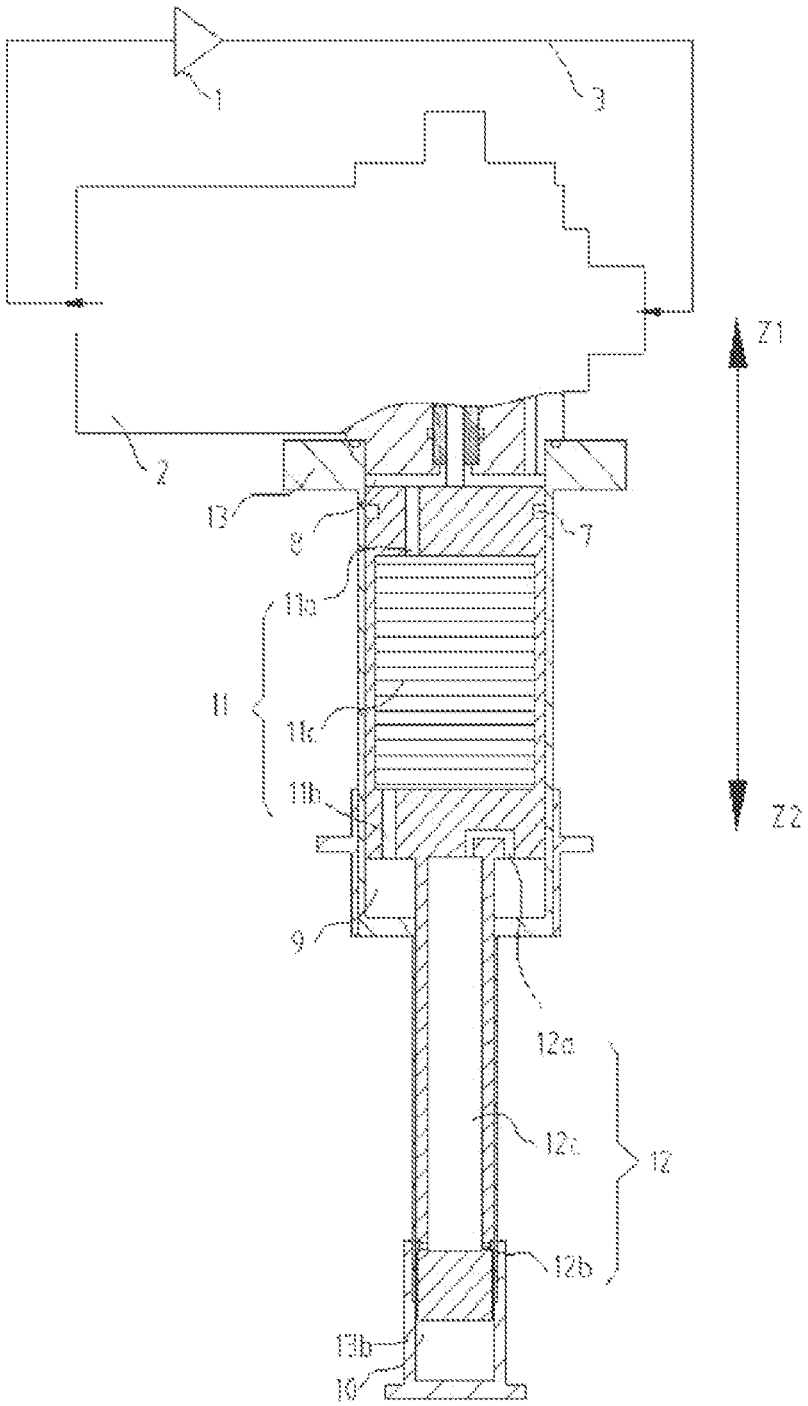
FIG. 3 is a schematic structural diagram of an ultra-low temperature refrigerator according to an implementation of the present invention.
Figure 4:
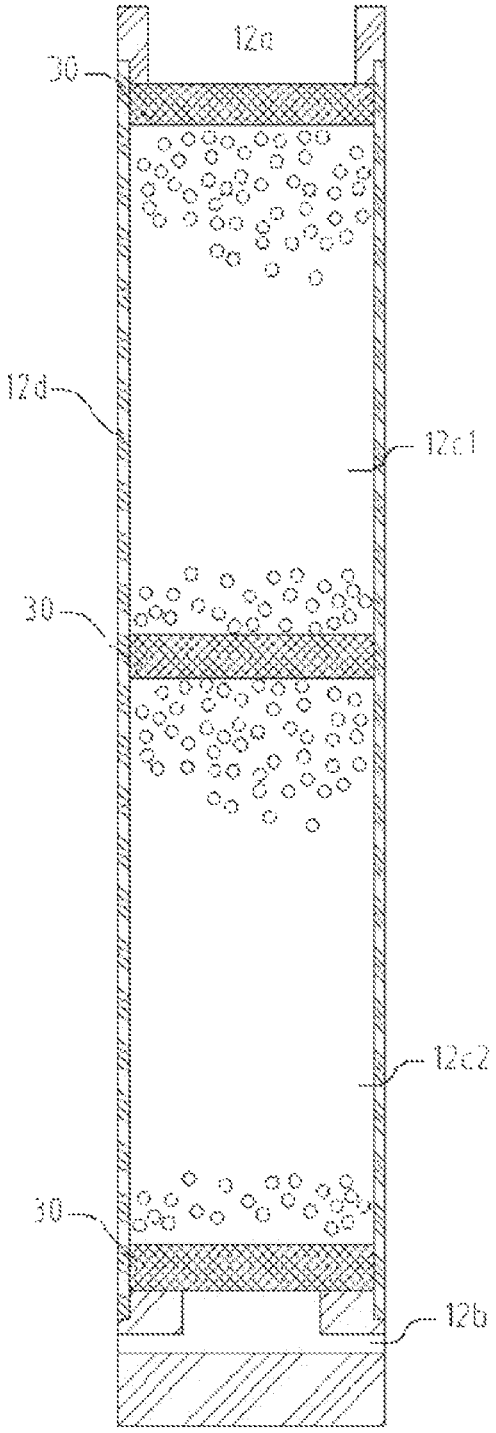
FIG. 4 is a structural cross-sectional view of a second-stage pushing piston in a GM refrigerator involved in an implementation of the present invention.

As shown in FIG. 2 to FIG. 4: a cold storage type cryogenic refrigerator is provided, including a cold storage device, where a cold storage material filled in the cold storage device is tin alloy particles. The foregoing cold storage device includes a first-stage pushing piston 11 and/or a second-stage pushing piston 12, and a first-stage cold storage material 11*c* filled in the first-stage pushing piston 11 and/or a second-stage cold storage material 12*c* filled in the second-stage pushing piston 12 uses tin alloy particles. When the first-stage cold storage material 11*c* uses tin alloy particles, the tin alloy particles serve as the first-stage cold storage material 11*c* of a cold end of the first-stage pushing piston 11; the second-stage cold storage material 12*c* includes a second-stage hot end cold storage material 12*c*1 and a second-stage cold end cold storage material 12*c*2, the tin alloy particles serve as the second-stage hot end cold storage material 12*c*1 of a hot end of the second-stage pushing piston 12 and the second-stage cold end cold storage material 12*c*2 of a cold end of the second-stage pushing piston 12 uses GOS or $HoCu_2$. It should be further noted that when the second-stage hot end cold storage material 12*c*1 uses the tin alloy particles and the second-stage cold end cold storage material 12*c*2 uses GOS or $HoCu_2$, the cold storage type cryogenic refrigerator is a 4-K cryogenic refrigerator for nuclear magnetic resonance and is applied to a superconductive system.

As shown in FIG. 3: FIG. 3 is a schematic structural diagram of a cryogenic refrigerator according to an embodiment of the present invention. The refrigerator includes a compressor 1, a cover assembly 2, a gas pipeline 3, an air cylinder 13, a first-stage pushing piston 11, and a second-stage pushing piston 12; the compressor 1, by inhaling and compressing a refrigerant gas, enables the refrigerant gas to be a high-pressure refrigerant gas to be discharged; the gas pipeline 3 supplies the high-pressure refrigerant gas to the cover assembly 2; and the air cylinder 13 is a two-stage air cylinder, and bodies are made of stainless steel 304 and arranged coaxially. The first-stage pushing piston 11 and the second-stage pushing piston 12 are connected coaxially, and driven by a driving mechanism (not shown in the figure) to move together along a Z1-Z2 direction in the air cylinder 13. When the first-stage pushing piston 11 and the second-stage pushing piston 12 move towards an upper direction of the figure (a Z1 direction), volumes of a first-stage expansion chamber 9 and a second-stage expansion chamber 10 increase. Otherwise, the volumes of the corresponding expansion chambers decrease.

Under a change of the volumes of the foregoing expansion chambers, an incoming refrigerant gas exchanges heat with the first-stage cold storage material 11*c* in the first-stage pushing piston 11 through a first-stage piston front hole 11*a*, and then flows out of a first-stage piston rear hole 11*b*; and a part of the gas expands in the first-stage expansion chamber 9, and the remaining gas flows into the second-stage pushing piston 12 through a second-stage piston front hole 12*a*, exchanges heat with the second-stage cold storage material 12*c* in the second-stage pushing piston, then flows out of an exhaust port 12*b*, and flows into the second-stage expansion chamber 10. In the process, the refrigerant gas transfers its own heat to the cold storage material, and a temperature changes from a normal temperature to a low temperature. Along the foregoing gas flow direction, that is, a Z2 direction, the air cylinder 13, the first-stage pushing piston 11 and the second-stage pushing piston 12 decrease continuously in temperature, to form a temperature gradient.

A flow process of a backflow gas is opposite to the foregoing flow process. A refrigerant gas flows out of the second-stage expansion chamber 10, exchanges heat with the second-stage cold storage material 12*c* in the second-stage pushing piston 12 through the exhaust port 12*b*, flows out of the second-stage piston front hole 12*a*, and mixes with a refrigerant gas in the first-stage expansion chamber 9; and then exchanges heat with the first-stage cold storage material 11*c* in the first-stage pushing piston 11 through the first-stage piston rear hole 11*b*, then flows into the cover assembly 2 through the first-stage piston front hole 11*a*, and then flows to a low-pressure side of the compressor 1. In the process, the refrigerant gas absorbs heat from the cold storage material, and a temperature changes from a low temperature to a normal temperature.

By performing the foregoing actions repetitively, the first-stage cold storage material 11*c*, the second-stage cold storage material 12*c* and the refrigerant gas are cooled down. The low-temperature gas expands to do work continuously in the first-stage expansion chamber 9 and the second-stage expansion chamber 10, to form a refrigeration source.

The second-stage cold storage material 12*c* in the second-stage pushing piston 12 is described below in detail.

As shown in FIG. 4, to improve a refrigeration effect of a refrigerator, according to different temperature zones, the second-stage cold storage material 12*c* is generally partitioned into two parts: the second-stage hot end cold storage material 12*c*1 and the second-stage cold end cold storage material 12*c*2, and accommodated in the cold storage device (the second-stage pushing piston 12). A second-stage piston front hole 12*a* is provided in an upper portion of the second-stage pushing piston 12, an exhaust port 12*b* is provided in a lower portion of the second-stage pushing piston, and the second-stage cold storage material 12*c* forms a porous passage, to form a through gas passageway. Three partition members 30 are mounted in the second-stage pushing piston 12, to firmly fix the second-stage hot end cold storage material 12*c*1 and the second-stage cold end cold storage material 12*c*2 in the second-stage pushing piston; the partition members 30 allow a refrigerant gas to flow through, but do not allow the cold storage material to pass through, and therefore the second-stage hot end cold storage material 12*c*1 and the second-stage cold end cold storage material 12*c*2 may be designed according to different temperature zones.

Specifically, after the year of 2002, cold storage materials in a 4.2-K temperature zone have developed dramatically. The second-stage cold end cold storage material 12*c*2 usually uses $HoCu_2$ or a combination of $HoCu_2$ and GOS ($Gd_2O_2S$: gadolinium oxysulfide), because in the temperature zone, the cold storage material of $HoCu_2$ and GOS has a larger specific heat than those of other cold storage materials, the cryogenic refrigerator has a better refrigeration effect, a refrigeration capacity may reach 1 W at 4.2 K, the cold storage material may be used in a magnetic field, and no attenuation occurs. The cold storage material has become a standard cold storage material of a 4-K cryogenic refrigerator, and is widely used in a nuclear magnetic resonance system to cool down a superconductive magnet.

Because a specific heat peak of GOS is at 5.2 K, after a temperature is higher than 5.2 K, the specific heat decreases dramatically; in addition, because $HoCu_2$ is a rare-earth metal material, and is expensive, it is neither economic nor feasible to fill $HoCu_2$ and GOS as all the cold storage materials in the second-stage pushing piston 12. Conventionally used lead (Pb) or a lead alloy has a large specific heat and a good heat exchange effect, and is cheap and accessible. However, lead as a heavy metal element is toxic to humans, animals and plants, and since the year of 2006, the world has controlled lead strictly. To decrease toxicity of the cold storage material, numerous enterprises outside China have replaced lead with a metal, bismuth (Bi). It has been verified that granular bismuth is used as the cold storage material, and is used in the cryogenic refrigerator. However, no authoritative conclusion has been reached on toxicity of bismuth. It is not necessarily appropriate to use a large amount of bismuth in the cryogenic refrigerator. Particularly, no conclusion has been reached on whether use of bismuth in the cryogenic refrigerator in a medical nuclear magnetic resonance system meets medical safety requirements.

Figure 5:
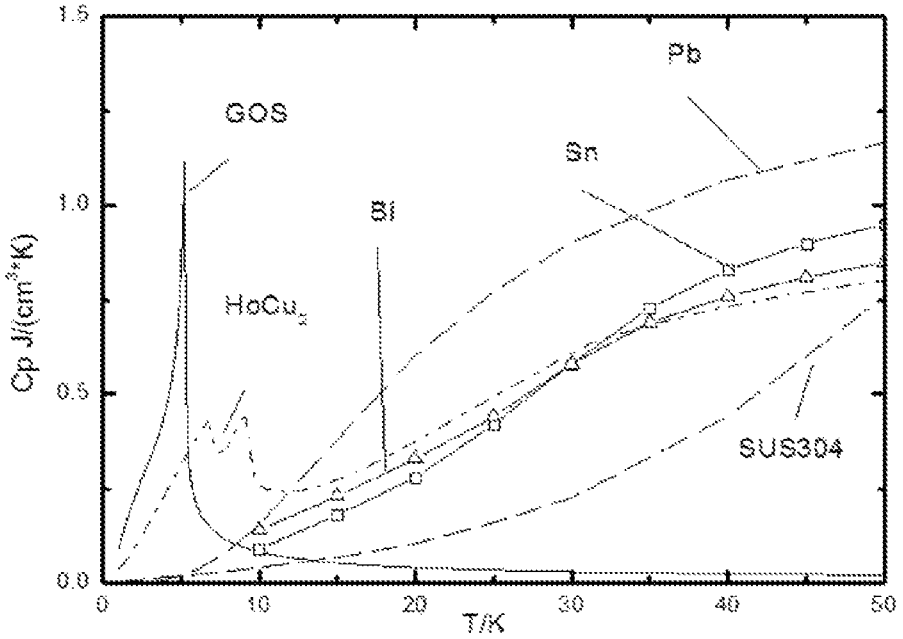
FIG. 5 is a volume-specific heat curve diagram of different cold storage materials involved in the present invention.

As shown in FIG. 5, a specific heat of a metal, tin, is very close to that of the metal, bismuth, and tin and lead are elements of a same group, and have close physical properties. In addition, tin is a metal harmless to humans, is usually used in food packaging, and is extremely accessible and cheap, and therefore is an ideal substitute material theoretically.

However, the metal, tin, has a "tin pest" problem. When a temperature is below 13° C., a crystal lattice of tin realigns, and a space between atoms increases, to form a new crystal form, that is, gray tin. Gray tin loses metal properties to become a semiconductor. Between different crystal lattices, an internal stress generated at a contact area enables the metal, tin, to break down into powder. Therefore, the present invention proposes that using a tin alloy particle as a cold storage material can resolve the foregoing problem. The selected particle may be a solder ball made of a tin alloy, where the solder ball is widely used in tinplate, a fluxing agent, organic synthesis, chemical production and alloy manufacturing, and assembling of groups of integrated circuits in the electronics industry. The solder ball has a low cost and is extremely accessible.

In a specific implementation process, the selected second-stage hot end cold storage material 12*c*1 uses tin as a main component, and has a mass fraction not less than 40% but not more than 99%; and at least includes one element of antimony, silver, bismuth and gold. After the content of the foregoing metal element reaches a certain level, occurrence of a transition to "tin pest" may be suppressed. To avoid the occurrence of the "tin pest", common tin alloys are binary alloys such as Sn-Ag, Sn-Sb, and Sn-Bi, and multi-component alloys such as Sn-Ag-Bi-Cu and Sn-Ag-Cu. The foregoing tin alloys are usually manufactured into solder balls, used for welding an integrated circuit plate. In the implementation process, hardness and densities of the cold storage materials are shown in Table 1.

TABLE 1

Table of comparison of Vickers harness and densities among different cold storage materials

| Material | | | | Tin alloy | | |
|---|---|---|---|---|---|---|
| name | $HoCu_2$ | Pb | Bi | Sn—Ag—Cu | Sn—Bi | Sn—Sb |
| Vickers hardness | 327 | 11.8 | 11.3 | 10.6 | 23 | 13 |
| Specific density | 8.89 | 11.34 | 9.8 | 7.4 | 8.56 | 7.25 |

As shown in Table 1, in terms of the hardness, the selected tin alloy particles have hardness comparable to that of lead, and in a process of repetitive impact tests, no particles break up. In addition, because a density of the tin alloy is smaller than those of lead and bismuth, a smaller amount is used under an equal volume, which is more economic and conducive to decreasing a cost of the cryogenic refrigerator.

Furthermore, in the process of implementation, if granules of the second-stage hot end cold storage material 12*c*1 are excessively small, flow of a refrigerant is hindered greatly, causing flow loss; if the granules are excessively big, a heat exchange area between the refrigerant and the second-stage hot end cold storage material 12*c*1 is insufficient, which is not conducive to refrigeration. In an ideal state, the second-stage hot end cold storage material 12*c*1 has a particle diameter in a range of 0.15 mm to 1 mm, and accounts for more than 65% of a total weight.

Figure 6:
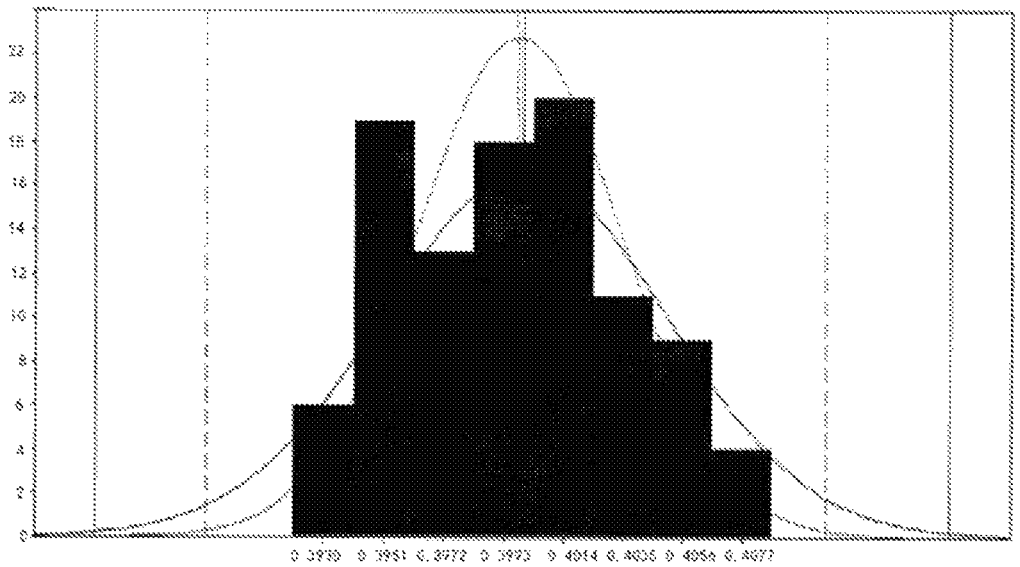
FIG. 6 is a histogram showing particle diameter distribution of a tin alloy cold storage material of the present invention.

In addition, the selected particles are easy in spherization. A ratio of a short diameter to a long diameter had better be greater than 0.7, a sphere diameter tolerance is +0.005 mm, and a roundness is less than 0.005 mm. FIG. 6 is a histogram showing particle diameters of a 0.4-mm spherical tin alloy cold storage material. Because the solder balls made of the tin alloy are cheap, in the implementation process, sizes may be further screened, and the solder balls of a consistent size may be selected as much as possible to perform tests.

Figure 7:
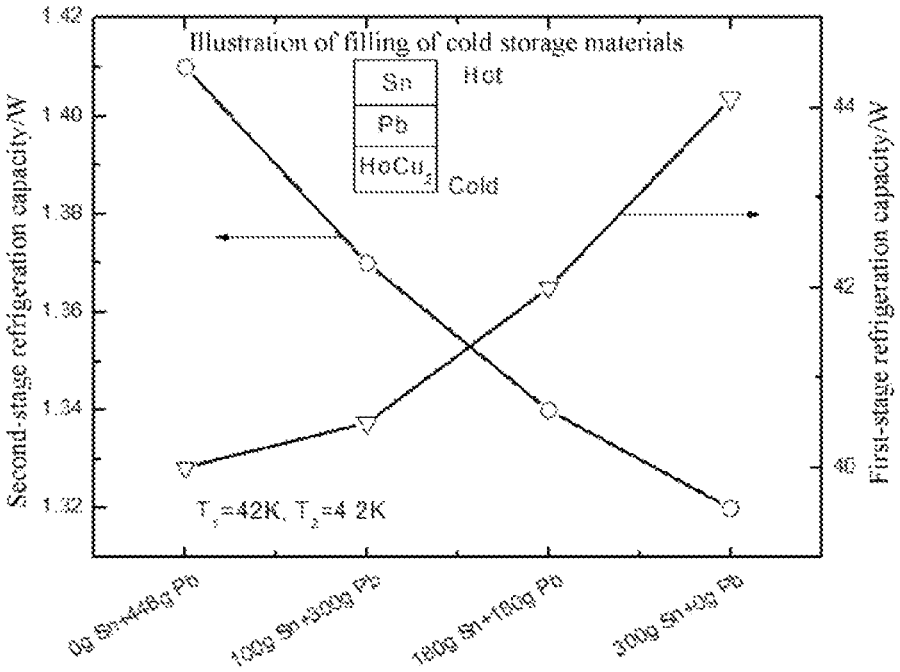
FIG. 7 is a property comparison chart of a tin alloy cold storage material of the present invention and a lead cold storage material (Sn in the figure represents a tin alloy)

In the present invention, a ternary alloy of Sn-Ag-Cu is used as an example to perform a comparison test of the second-stage hot end cold storage material 12*c*1, and based on a 4.2-K cryogenic refrigerator of 1.2 W, properties of the tin alloy cold storage material are evaluated. FIG. 7 (Sn in the figure represents a ternary tin alloy of Sn-Ag-Cu) is a property comparison chart of a tin alloy cold storage material and a lead cold storage material. A first-stage refrigeration temperature is controlled to be 42 K, a second-stage refrigeration temperature is controlled to be 4.2 K, and an extra combination form of three layers of fillers of a tin alloy, lead and holmium-cuprum is added to perform a property comparison test, where combination manners are shown in FIG. 7. The lead cold storage material decreases, until the lead cold storage material is entirely replaced with the tin alloy. Although a refrigeration capacity in a 4.2-K temperature zone attenuates by 6.4%, the refrigeration capacity reaches more than 1.3 W, which can completely meet requirements of 1.5T nuclear magnetic resonance.

Figure 8:
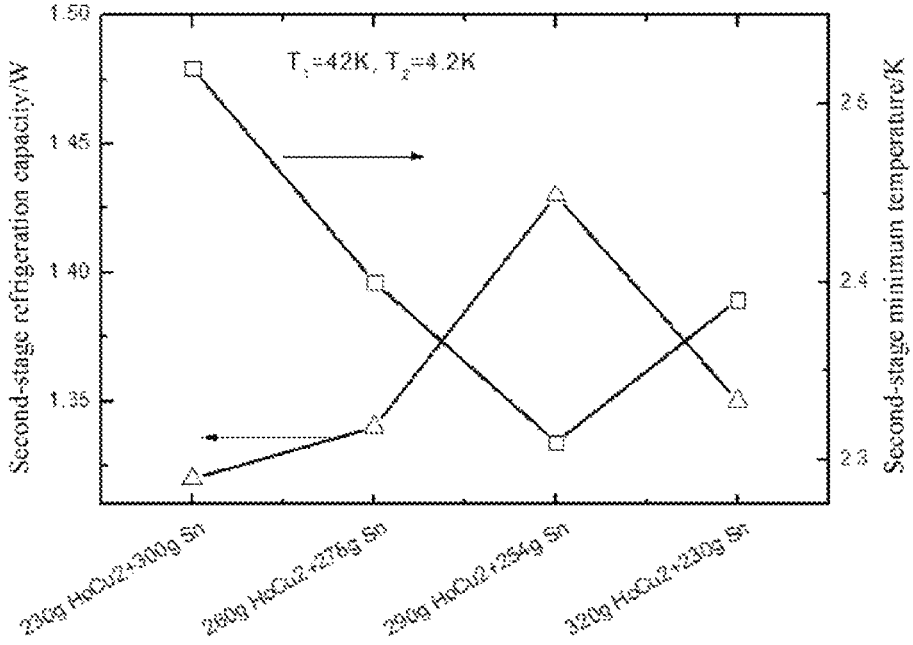
FIG. 8 is a property comparison chart of different filling proportions of holmium-cuprum and a tin alloy in a tin alloy cold storage device of the present invention (Sn in the figure represents a tin alloy)

In addition, to compensate for the property attenuation of a cold storage device caused by the tin alloy cold storage material, a filling amount of holmium-cuprum is properly increased, so that the filling amount of holmium-cuprum is slightly greater than that of the tin alloy cold storage material, as shown in FIG. 8. By using the method, properties of a tin alloy cold storage device can be improved to be comparable to those of a lead cold storage device. Meanwhile, it can be seen from FIG. 7 that after the lead cold storage material is replaced with the tin alloy cold storage material, a first-stage refrigeration capacity can be improved. Therefore, from the perspective of comprehensive consideration, it is a feasible solution to replace the lead cold storage material with the tin alloy.

Figure 9:
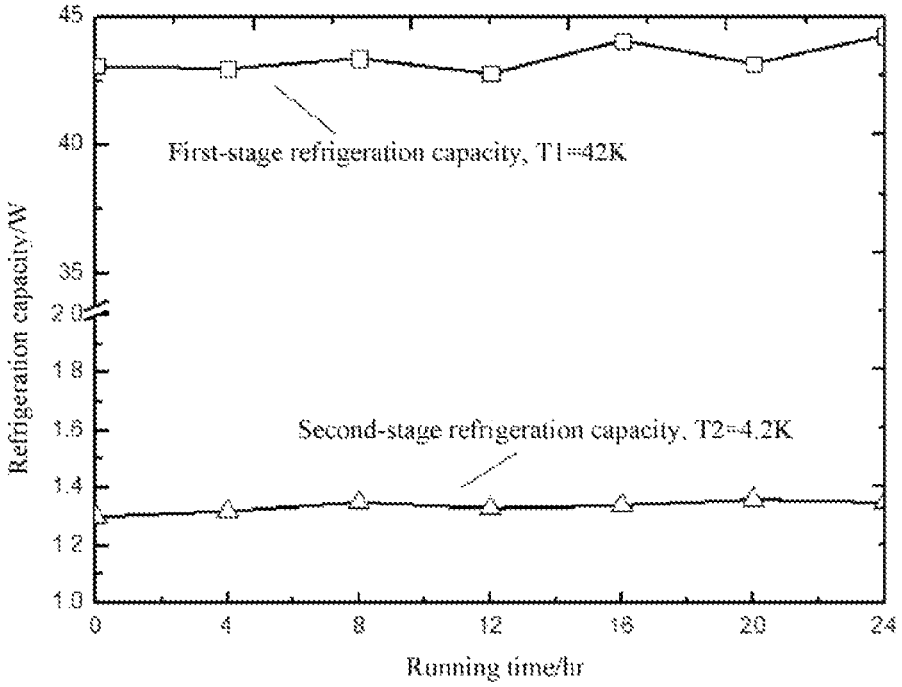
FIG. 9 is a performance test view of 24-h short-term stability of a cryogenic refrigerator of the present invention.

In the implementation solution, stability of the tin alloy cold storage material is studied through a 24-hour short-term stability test, as shown in FIG. 9. In a testing process, a cold storage device experiences repetitive cold-and-hot impacts, and by checking the tin alloy cold storage material, there are no phenomena of breaking up and powdering, indicating that the tin alloy is a cold storage material that can be used in a cryogenic refrigerator.

In the implementation solution, the second-stage cold end cold storage material 12*c*2 of a cold end of the second-stage pushing piston uses holmium-cuprum, or uses a combination of holmium-cuprum and GOS to improve properties of the refrigerator.

As described above, in the implementation solution, the tin alloy is used as the second-stage hot end cold storage material 12*c* 1 of the second-stage pushing piston 12 of the cold storage type refrigerator, and the second-stage hot end cold storage material 12*c*1 may be manufactured through a melted metal quenching method or a plasma or gas atomization method.

The cold storage device in which the cold storage material of the present invention is filled is the second-stage pushing piston 12 of a two-stage cryogenic refrigerator in the implementation solution, as shown in FIG. 2 and FIG. 4, and has tin alloy cold storage material particles provided by the present invention. Meanwhile, the cold storage type cryogenic refrigerator provided by the present invention has a cryogenic cold storage device filled with tin alloy particles as the second-stage hot end cold storage material 12*c*1; and the tin alloy particles may be combined with holmium-cuprum and GOS to be used in a 4-K cryogenic refrigerator for nuclear magnetic resonance to cool down a superconductive magnet.

In the foregoing implementation solutions, the cold storage material provided by the present invention is applicable to a Gifford-McMahon (GM) refrigerator, a Stirling refrigerator, a Solvag refrigerator or a pulse tube refrigerator, but is not limited to the foregoing cryogenic refrigerators. Any cryogenic refrigerator having a cold storage device is applicable.

The cold storage material provided by the present invention is lead-free, lowly toxic, easy in spherization and extremely accessible and has a relatively good thermal performance, and the cold storage material has properties comparable to those of lead; and the cold storage material has a relatively good heat exchange performance, when being used in a cold storage type refrigerator.

The foregoing embodiments are only used for explaining the technical idea of the present invention, and are not intended to limit the protection scope of the present invention. Any changes made based on the technical solution and according to the technical idea proposed by the present invention shall fall within the protection scope of the present invention; the technologies not involved in the present invention can be implemented by the existing technologies.

The invention claimed is:

1. A cold storage type cryogenic refrigerator using a cold storage material, wherein the cold storage material is tin alloy particles, and the content of tin in the tin alloy particle is not less than 40% and not more than 99%, the cold storage type cryogenic refrigerator comprising a cold storage device, wherein the cold storage material filled in the cold storage device is tin alloy particles, wherein the cold storage device comprises a first-stage pushing piston (11) and/or a second-stage pushing piston (12), and a first-stage cold storage material (11*c*) filled in the first-stage pushing piston (11) and/or a second-stage cold storage material (12*c*) filled in the second-stage pushing piston (12) uses tin alloy particles, and wherein the second-stage cold storage material (12*c*) comprises a second-stage hot end cold storage material (12*c*1) and a second-stage cold end cold storage material (12*c*2), the tin alloy particles serve as the second-stage hot end cold storage material (12*c*1) of a hot end of the second-stage pushing piston (12) and the second-stage cold end cold storage material (12*c*2) of a cold end of the second-stage pushing piston (12) uses GOS or $HoCu_2$.

2. The cold storage type cryogenic refrigerator according to claim 1, wherein when the second-stage hot end cold storage material (12*c*1) uses the tin alloy particles and the second-stage cold end cold storage material (12*c*2) uses GOS or $HoCu_2$, the cold storage type cryogenic refrigerator is a 4-K cryogenic refrigerator for nuclear magnetic resonance and is applied to a superconductive system.

3. A cold storage type cryogenic refrigerator using a cold storage material, wherein the cold storage material is tin alloy particles, and the content of tin in the tin alloy particle is not less than 40% and not more than 99%, the cold storage type cryogenic refrigerator comprising a cold storage device, wherein the cold storage material filled in the cold storage device is tin alloy particles, wherein the cold storage device comprises a first-stage pushing piston (11) and/or a second-stage pushing piston (12), and a first-stage cold storage material (11*c*) filled in the first-stage pushing piston (11) and/or a second-stage cold storage material (12*c*) filled in the second-stage pushing piston (12) uses tin alloy particles, wherein when the first-stage cold storage material (11*c*) uses tin alloy particles, the tin alloy particles serve as the first-stage cold storage material (11*c*) of a cold end of the first-stage pushing piston (11), and wherein the second-stage cold storage material (12*c*) comprises a second-stage hot end cold storage material (12*c*1) and a second-stage cold end cold storage material (12*c*2), the tin alloy particles serve as the second-stage hot end cold storage material (12*c*1) of a hot end of the second-stage pushing piston (12) and the second-stage cold end cold storage material (12*c*2) of a cold end of the second-stage pushing piston (12) uses GOS or $HoCu_2$.

4. The cold storage type cryogenic refrigerator according to claim 3, wherein when the second-stage hot end cold storage material (12*c*1) uses the tin alloy particles and the second-stage cold end cold storage material (12*c*2) uses GOS or $HoCu_2$, the cold storage type cryogenic refrigerator is a 4-K cryogenic refrigerator for nuclear magnetic resonance and is applied to a superconductive system.

* * * * *